US008220895B2

(12) United States Patent
Hayashi et al.

(10) Patent No.: US 8,220,895 B2
(45) Date of Patent: Jul. 17, 2012

(54) LIQUID-DISCHARGE-FAILURE DETECTING APPARATUS, INKJET RECORDING APPARATUS, AND METHOD OF DETECTING LIQUID DISCHARGE FAILURE

(75) Inventors: Hirotaka Hayashi, Aichi (JP); Kazumasa Ito, Gifu (JP)

(73) Assignee: Ricoh Elemex Corporation, Nagoya (JP)

( * ) Notice: Subject to any disclaimer, the term of this patent is extended or adjusted under 35 U.S.C. 154(b) by 703 days.

(21) Appl. No.: 12/191,110

(22) Filed: Aug. 13, 2008

(65) Prior Publication Data

US 2010/0039462 A1 Feb. 18, 2010

(51) Int. Cl.
*B41J 29/393* (2006.01)

(52) U.S. Cl. ..... 347/19; 347/10

(58) Field of Classification Search ..... 347/10, 347/19

See application file for complete search history.

(56) References Cited

U.S. PATENT DOCUMENTS

| | | | | |
|---|---|---|---|---|
| 4,222,060 | A * | 9/1980 | Sato et al. | 347/9 |
| 5,621,524 | A * | 4/1997 | Mitani | 356/338 |
| 5,898,443 | A * | 4/1999 | Yoshino et al. | 347/19 |
| 6,224,183 | B1 * | 5/2001 | Kono et al. | 347/19 |
| 6,322,190 | B1 * | 11/2001 | Kono et al. | 347/19 |
| 6,450,604 | B1 * | 9/2002 | Iwaishi et al. | 347/10 |
| 6,775,022 | B2 * | 8/2004 | Noyes et al. | 358/1.15 |
| 2002/0018090 | A1 * | 2/2002 | Takazawa et al. | 347/19 |
| 2002/0122748 | A1 * | 9/2002 | Hirota et al. | 422/100 |
| 2003/0007026 | A1 * | 1/2003 | Matsumoto et al. | 347/19 |
| 2004/0036735 | A1 * | 2/2004 | Garbacz et al. | 347/22 |
| 2004/0056915 | A1 * | 3/2004 | Miyazawa | 347/19 |
| 2004/0095410 | A1 * | 5/2004 | Miyashita | 347/19 |
| 2005/0057596 | A1 * | 3/2005 | Shinkawa et al. | 347/19 |
| 2005/0057598 | A1 * | 3/2005 | Endo et al. | 347/19 |
| 2005/0062781 | A1 * | 3/2005 | Shinkawa | 347/19 |
| 2005/0062782 | A1 * | 3/2005 | Endo et al. | 347/19 |
| 2005/0073547 | A1 * | 4/2005 | Endo | 347/19 |
| 2005/0122360 | A1 * | 6/2005 | Sakagami et al. | 347/19 |
| 2005/0128232 | A1 * | 6/2005 | Shinkawa | 347/10 |
| 2005/0146550 | A1 * | 7/2005 | Kusakari | 347/19 |
| 2005/0212844 | A1 * | 9/2005 | Nishihara | 347/19 |
| 2005/0270318 | A1 * | 12/2005 | Noda | 347/10 |
| 2006/0125869 | A1 * | 6/2006 | Mitani et al. | 347/19 |
| 2006/0139392 | A1 * | 6/2006 | Fernandez et al. | 347/19 |
| 2006/0158477 | A1 * | 7/2006 | Kusakari et al. | 347/19 |
| 2007/0024658 | A1 * | 2/2007 | Diol et al. | 347/19 |
| 2008/0084442 | A1 * | 4/2008 | Misumi | 347/14 |
| 2008/0088655 | A1 * | 4/2008 | Oki et al. | 347/10 |

FOREIGN PATENT DOCUMENTS

| | | | |
|---|---|---|---|
| EP | 0 461 437 | A2 | 12/1991 |
| JP | 8-336986 | A | 12/1996 |
| JP | 2003-205623 | A | 7/2003 |
| JP | 2005-083769 | A | 3/2005 |
| JP | 2005-280248 | A | 10/2005 |
| JP | 2007-005363 | A | 1/2007 |

* cited by examiner

*Primary Examiner* — Charlie Peng
*Assistant Examiner* — Peter Radkowski
(74) *Attorney, Agent, or Firm* — Foley & Lardner LLP

(57) ABSTRACT

A light-emitting element emits a beam onto a droplet discharged from a nozzle. A light-receiving element receives a scattered light generated by scattering of the beam by the droplet. A discharge-speed controller controls a speed of discharge of the droplet from the nozzle to be set at the speed outside a normal discharge-speed range that is determined depending on a viscosity of a liquid. Finally, a failure detecting unit detects a liquid discharge failure from data of the scattered light received by the light-receiving element.

7 Claims, 9 Drawing Sheets

LIQUID-DISCHARGE-FAILURE DETECTING APPARATUS, INKJET RECORDING APPARATUS, AND METHOD OF DETECTING LIQUID DISCHARGE FAILURE

CROSS-REFERENCE TO RELATED APPLICATIONS

The present application claims priority to and incorporates by reference the entire contents of Japanese priority document 2007-043268 filed in Japan on Feb. 23, 2007.

BACKGROUND OF THE INVENTION

1. Field of the Invention

The present invention relates to a technology for detecting a liquid discharge failure in an inkjet recording apparatus.

2. Description of the Related Art

A typical image forming apparatus includes a plurality of nozzles that discharge droplets under a predetermined condition, a discharge-detecting unit that checks discharge of the droplets from the nozzles, and a recovery-control unit that controls timing of performing a recovery process on the nozzles based on the result of a check performed by the discharge-detecting unit. Such an image forming apparatus has been disclosed in Japanese Patent Application Laid-open No. 2005-280248. Strict regulations are imposed to improve the accuracy of detection of the droplets. For example, a diameter of a detection nozzle is made smaller than that of a recording nozzle, amplitude of a drive waveform of voltage for driving the detection nozzle is made smaller than that for driving the recording nozzle, and a rise time of the drive waveform for the detection nozzle is made longer than that for the recording nozzle.

On the other hand, in the method of monitoring droplets disclosed in Japanese Patent Application Laid-open No. 2005-083769, at least one pair of parallel laser lights is emitted, a nozzle discharges a droplet aiming between the laser lights, and each of light-receiving elements receives a corresponding laser light to perform photoelectric conversion. Because output signals from the light-receiving element momentarily drop when the droplet crosses the laser light, information on the droplet is obtained by detecting the output signals. For example, there is an image forming apparatus in which two pairs of parallel laser lights emitted at right angles, and its nozzle discharges a droplet aiming at an intersectional square.

However, the image forming apparatus disclosed in Japanese Patent Application Laid-open No. 2005-280248 needs to include the detection nozzle in addition to the recording nozzle, and therefore its configuration is complicated. Furthermore, because the discharge of the droplets is checked using the detection nozzle instead of the recording nozzle that is actually used to record an image, the detection result is not completely reliable. On the other hand, the image forming apparatus disclosed in Japanese Patent Application Laid-open No. 2005-083769 needs to include four light-emitting elements and four light-receiving elements to emit two pairs of parallel laser lights, resulting in high cost.

SUMMARY OF THE INVENTION

It is an object of the present invention to at least partially solve the problems in the conventional technology.

According to an aspect of the present invention, there is provided a liquid-discharge-failure detecting apparatus that detects a liquid discharge failure of a nozzle being arranged on an inkjet head surface and discharging droplets of a liquid. The liquid-discharge-failure detecting apparatus includes a discharge-speed controller that controls a speed of discharge of droplets discharged from the nozzle such that the speed is outside a normal discharge-speed range that is determined depending on a viscosity of the liquid; a light-emitting element that emits a beam onto a droplet discharged from the nozzle; a light-receiving element that receives a scattered light generated by scattering of the beam by the droplet; and a failure detecting unit that detects the liquid discharge failure from data of the scattered light received by the light-receiving element.

According to another aspect of the present invention, there is provided an inkjet recording apparatus including the above liquid-discharge-failure detecting apparatus.

According to still another aspect of the present invention, there is provided a method of detecting liquid discharge failure of a nozzle being arranged on an inkjet head surface and discharging droplets of a liquid. The method includes controlling a speed of discharge of droplets discharged from the nozzle such that the speed is outside a normal discharge-speed range that is determined depending on a viscosity of the liquid; and emitting a beam onto a droplet discharged from the nozzle with a light-emitting element and receiving a scattered light generated by scattering of the beam by the droplet with a light-receiving element; and detecting the liquid discharge failure from data of the scattered light received by the light-receiving element.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1A:
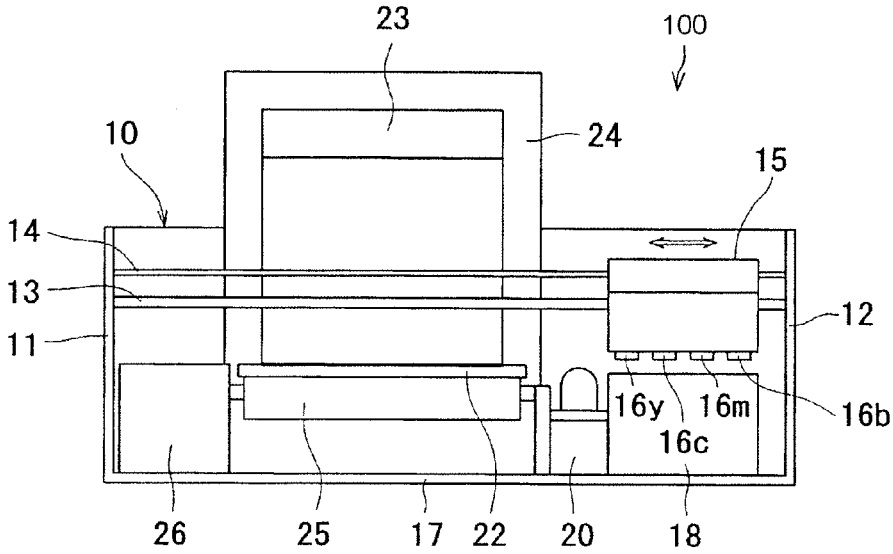
FIG. 1A is a schematic diagram of an inkjet recording apparatus including a liquid-discharge-failure detecting apparatus according to a first embodiment of the present invention.
Figure 1B:
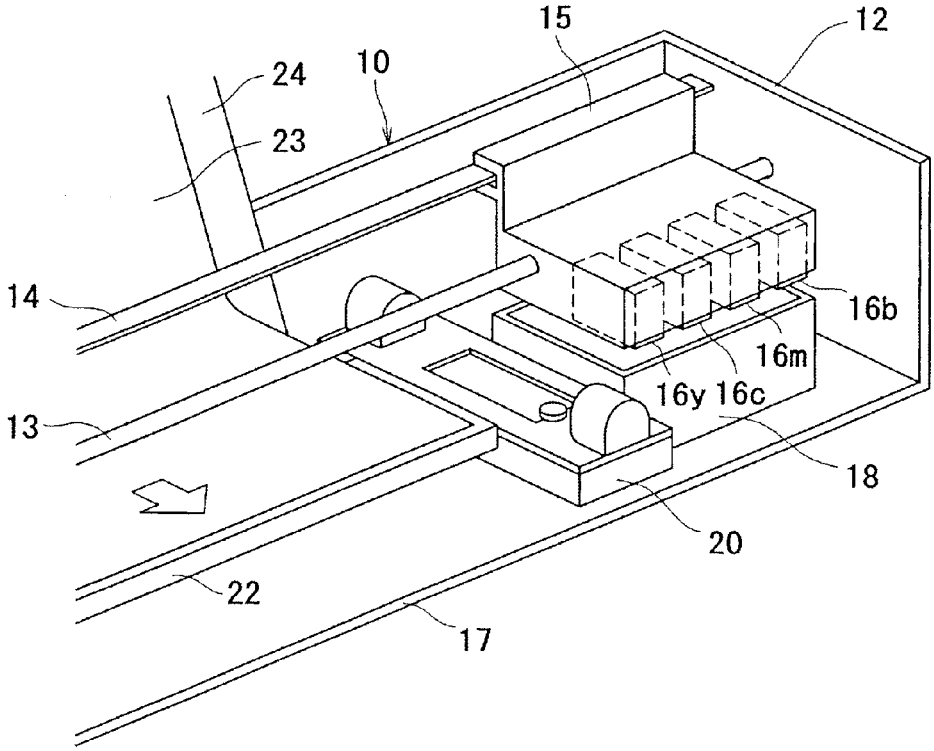
FIG. 1B is an enlarged perspective view of a part of the inkjet recording apparatus shown in FIG. 1A.

FIG. 1A is a schematic diagram of an inkjet recording apparatus 100 including a liquid-discharge-failure detecting apparatus 20 according to a first embodiment of the present invention, and FIG. 1B is an enlarged perspective view of a part of the inkjet recording apparatus 100.

The inkjet recording apparatus 100 includes a casing 10 having side walls 11 and 12, a guide shaft 13 and a guide plate 14 hanging between the side walls 11 and 12 in parallel with each other, and a carriage 15 supported by the guide shaft 13 and the guide plate 14. An endless belt (not shown) is hung on the carriage 15, a driving pulley (not shown), and a driven pulley (not shown), where the driving pulley and the driven pulley are arranged on the right side and the left side of the casing 10. When the driving pulley rotates, the driven pulley is rotated to run the endless belt, thereby moving the carriage 15 from side to side as indicated by an arrow in FIG. 1A.

The carriage 15 includes four heads including a yellow inkjet head 16*y*, a cyan inkjet head 16*c*, a magenta inkjet head 16*m*, and a black inkjet head 16*b* arranged in the moving direction of the carriage 15. However, the number of heads can be more than four. The heads 16*y*, 16*c*, 16*m*, and 16*b* will be collectively referred to as the inkjet heads 16. Each of the inkjet heads 16 has a plurality of nozzles (not shown) arranged in a one-dimensional array along the bottom of the inkjet head 16. The nozzle array is arranged perpendicular to the moving direction of the carriage 15.

When the carriage 15 is at its home position in the right side of the casing 10 as shown in FIGS. 1A and 1B, the inkjet heads 16 are opposed to a stand-alone recovery unit 18 arranged on a bottom plate 17 of the casing 10. The stand-alone recovery unit 18 suctions ink from a nozzle that is determined to be faulty by the liquid-discharge-failure detecting apparatus 20. As a result of this, inkjet recording apparatus 100 recovers from the liquid-discharge failure internally.

The liquid-discharge-failure detecting apparatus 20 is arranged next to the stand-alone recovery unit 18 on the bottom plate 17. A configuration of the stand-alone recovery unit 18 will be described in detail later.

A platen 22 in the form of a plate is arranged next to the liquid-discharge-failure detecting apparatus 20. Behind the platen 22, a paper feed tray 24 stands tilted to retain a sheet 23 as a recording medium. The inkjet recording medium further includes a feed roller (not shown) that feeds the sheet 23 from the paper feed tray 24 onto the platen 22, and a conveyance roller 25 that ejects the sheet 23 on the platen 22 to a front side of the inkjet recording apparatus 100.

A drive unit 26 is arranged on the bottom plate 17 in the left side of the casing 10. The drive unit 26 drives the feed roller, the conveyance roller 25, and the driving pulley, thereby running the endless belt to move the carriage 15.

For recording, the drive unit 26 drives the feed roller to feed the sheet 23 to a predetermined position on the platen 22, and moves the carriage 15 over the sheet 23 from right to left. While the carriage 15 is moving left, each nozzle in the inkjet heads 16 discharges ink droplets, thereby recording a partial image on the sheet 23. After the partial image is recorded, the drive unit 26 returns the carriage 15 to the home position and conveys the sheet 23 to a direction indicated by an arrow in FIG. 1B by a predetermined distance.

The drive unit 26 again moves the carriage 15 to the left discharging ink droplets from the nozzles to record a next partial image on the sheet 23. As described above, the drive unit 26 returns the carriage 15 to the home position and conveys the sheet 23. The inkjet recording apparatus 100 repeats a recording process described above until the whole image is recorded on the sheet 23.

Figure 2:
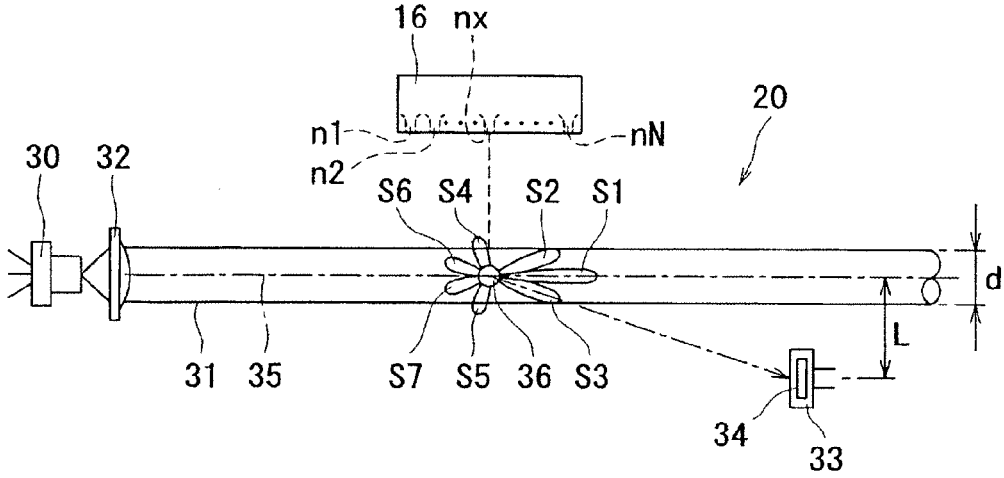
FIG. 2 is a schematic diagram for explaining how to perform a detecting process on an inkjet head shown in FIG. 1A using the liquid-discharge-failure detecting apparatus.

FIG. 2 is a schematic diagram for explaining how to perform a detecting process on a single inkjet head 16 using the liquid-discharge-failure detecting apparatus 20, as viewed from the left side of the inkjet recording apparatus 100 in a direction in parallel with the guide shaft 13.

The inkjet head 16 has nozzles n1, n2, . . . , nx, . . . , nN arranged in the nozzle array. The liquid-discharge-failure detecting apparatus 20 includes a light-emitting element 30, a collimating lens 32, and a light-receiving element 33. The light-emitting element 30 is, for example, a semiconductor laser. The collimating lens 32 collimates a light emitted by the light-emitting element 30 to form a beam 31 with a diameter of d. The light-receiving element 33 is, for example, a photodiode. A position of the light-receiving element 33 is determined so that its light-receiving surface 34 does not interrupt the beam 31, that the light-receiving element 33 is as close to an optical axis 35 of the beam 31 as possible though it is offset from the optical axis 35 by a distance L, and that the light-receiving element 33 receives a part of scattered lights S1, S2, S3, S4, S5, S6, and S7 generated when an ink droplet 36 is discharged onto the beam 31. In FIG. 2, the light-receiving element 33 is positioned to receive the forward-scattered light S3. The liquid-discharge-failure detecting apparatus 20 is arranged so that the beam 31 is emitted at a right angle to a direction of discharge of the ink droplet 36 from the nozzle nx. When the inkjet head 16 is small, a light-emitting diode can be used as the light-emitting element 30 to reduce a production cost.

To detect a liquid discharge failure, the collimating lens 32 collimates the light emitted by the light-emitting element 30 to generate the beam 31, which travels at a right angle to the direction of discharge of the ink droplet 36. When the ink droplet 36 is correctly discharged, it falls on the beam 31 to generate the scattered lights S1, S2, S3, S4, 5, S6, and S7, and the scattered light S3 is received by the light-receiving element 33. When the ink droplet 36 is not correctly discharged, the beam 31 travels straight without being interrupted by the ink droplet 36, and therefore the light-receiving element 33 does not receive the scattered light S3. By measuring voltage output from the light-receiving element 33, an amount of optical power received by the light-receiving element 33 is determined. If a large amount of the optical power is received, it means that the ink droplet 36 is correctly discharged. If only a small amount of the optical power is received, it means that there is a liquid discharge failure.

Figure 3A:
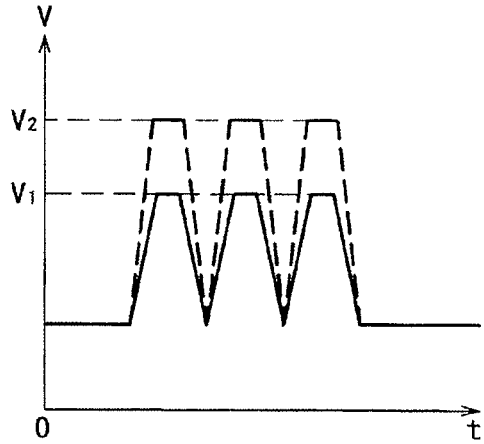
FIGS. 3A and 3B are graphs of drive waveforms of voltage for discharging ink from a nozzle shown in FIG. 2.
Figure 3B:
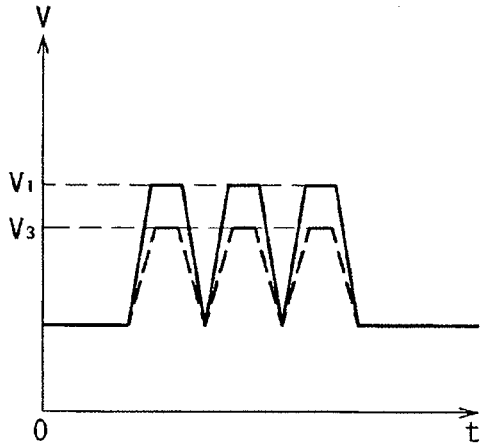

FIGS. 3A and 3B are graphs of drive waveforms of voltage for discharging ink from the nozzle nx. In either one of FIGS. 3A and 3B, a solid curve indicates a drive waveform of a drive voltage $V_1$ that is normally used. A dotted curve shown in FIG. 3A indicates a drive waveform of a drive voltage $V_2$ higher than the drive voltage $V_1$, and a dotted curve shown in FIG. 3B indicates a drive waveform of a drive voltage $V_3$ lower than the drive voltage $V_1$.

Figure 4:
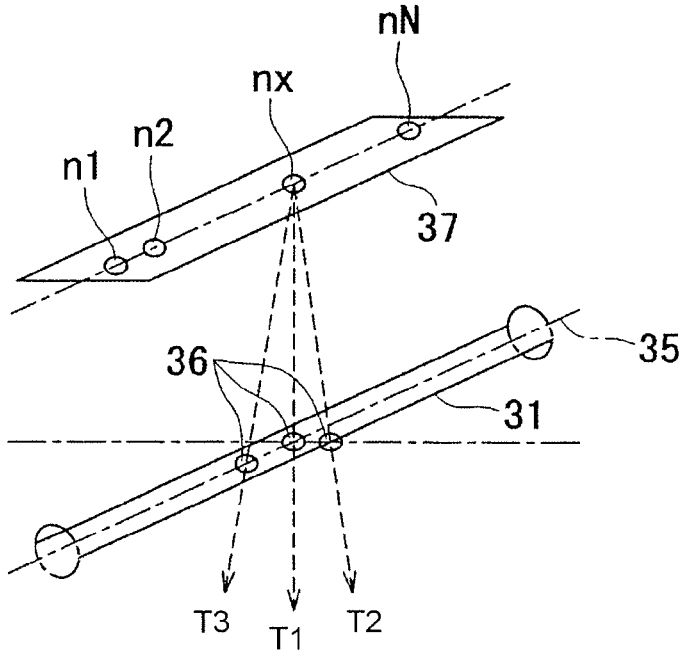
FIG. 4 is a schematic diagram of trajectories of a droplet discharged from the nozzle.

FIG. 4 is a schematic diagram of trajectories of the ink droplet 36 discharged from the nozzle nx. A dotted arrow T1 indicates a trajectory of the ink droplet 36 correctly discharged from the nozzle nx to fall on the sheet 23 at a right angle. A dotted arrow T2 indicates a trajectory of the ink droplet 36 when the trajectory bends at a right angle to the nozzle array. A dotted arrow T3 indicates a trajectory of the ink droplet 36 when the trajectory bends in parallel with the nozzle array. When a faulty nozzle discharges the ink droplet 36, the ink droplet 36 splits or follows a curved trajectory. Therefore, the trajectory can sometimes bend in parallel with the nozzle array depending on presence of an obstacle or a degree of defective shape of the nozzle.

Figure 5:
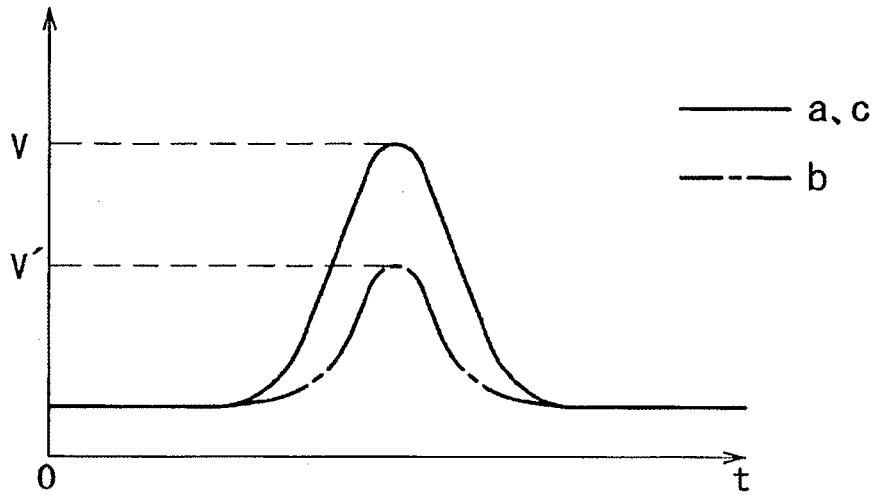
FIG. 5 is a graph of optical power received by a light-receiving element shown in FIG. 2 when the ink droplet follows trajectories T1, T2, and T3 shown in FIG. 4.

FIG. 5 is a graph of the optical power received by the light-receiving element 33 when the ink droplet 36 follows the trajectories T1, T2, and T3. When the ink droplet 36 follows the trajectory T1, the ink droplet 36 passes the center of the beam 31 where the optical intensity is the highest, and therefore the light-receiving element 33 outputs a high voltage V. In the case of the trajectory T2, the ink droplet 36 deviates from the center of the beam 31, and therefore the light-receiving element 33 outputs a voltage V', which is lower than the voltage V. In the case of the trajectory T3, the ink droplet 36 passes the center of the beam 31 despite the bending trajectory, and the light-receiving element 33 outputs the high voltage V. Therefore, in the case of the trajectory T3, there is a risk of determining that the nozzle nx is not faulty.

Figure 6A:
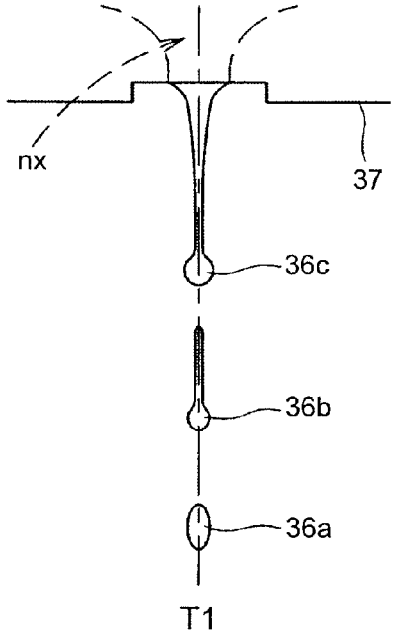
FIGS. 6A and 6B are schematic diagrams for explaining how the ink droplet is discharged along the trajectory T1.
Figure 6B:
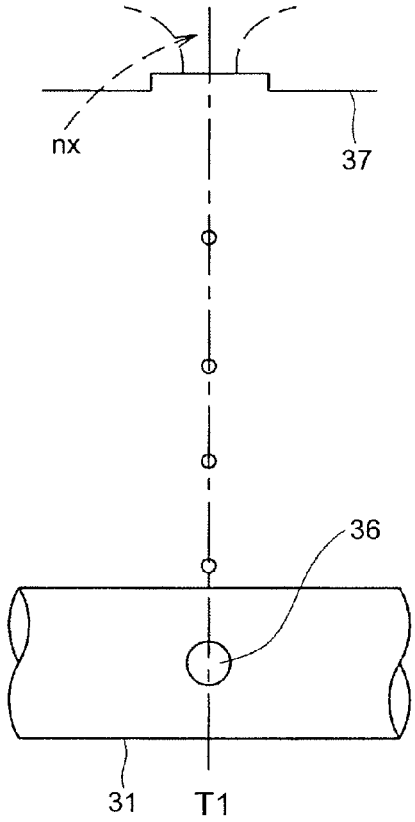

FIGS. 6A and 6B are schematic diagrams for explaining how the ink droplet 36 is discharged along the trajectory T1. In the case of the correct discharge of the ink droplet 36, the nozzle nx arranged on an inkjet head surface 37 discharges a plurality of ink droplets 36*a*, 36*b*, and 36*c* continuously as shown in FIG. 6A, which coalesce into a single ink droplet 36 during flight, as shown in FIG. 6B.

Figure 7A:
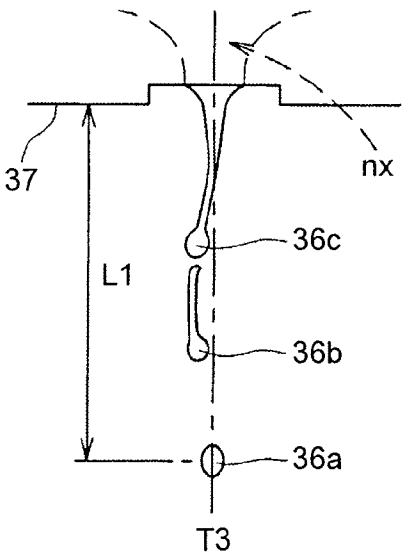
FIGS. 7A, 7B, and 7C are schematic diagrams for explaining how the ink droplet is discharged along the trajectory T3.
Figure 7B:
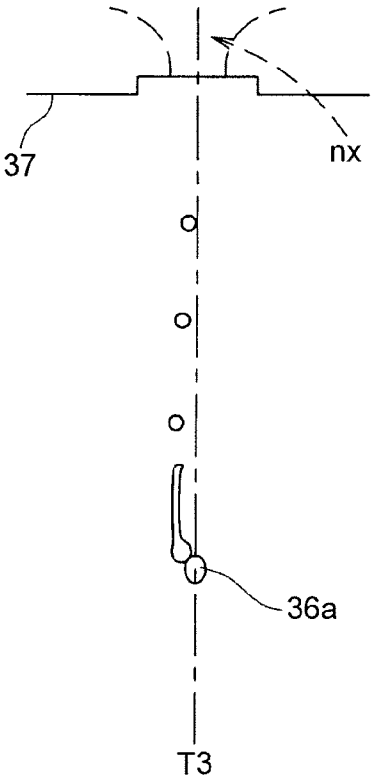
Figure 7C:
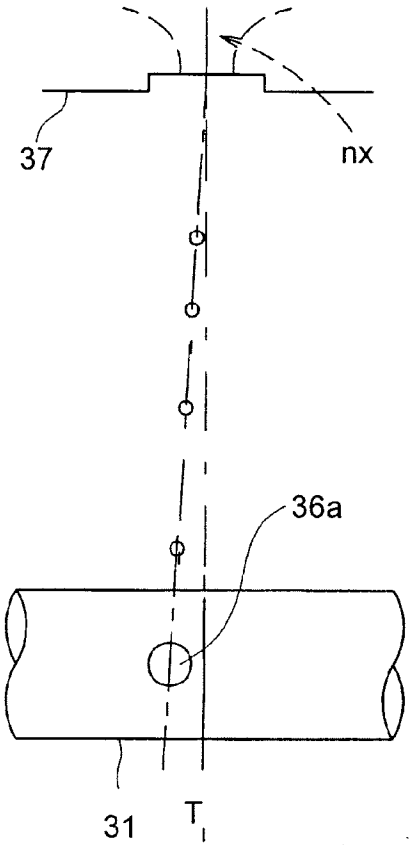

FIGS. 7A, 7B, and 7C are schematic diagrams for explaining how the ink droplet 36 is discharged along the trajectory T3. Even when the trajectory bends in parallel with the nozzle array, the droplets 36*a*, 36*b*, and 36*c* coalesce into the single ink droplet 36 during flight as in the case of the correct discharge. However, for example, the ink droplets 36*b* and 36*c* follow the bending trajectory as shown in FIG. 7A, due to a foreign object or a projection in the nozzle or near the nozzle. When the trajectory bends in parallel with the nozzle array, the ink droplet 36*a* is attracted to a droplet coalesced from the ink droplets 36*b* and 36*c*, as shown in FIG. 7B. The trajectory finally bends in parallel with the nozzle array, as shown in FIG. 7C.

Figure 8A:
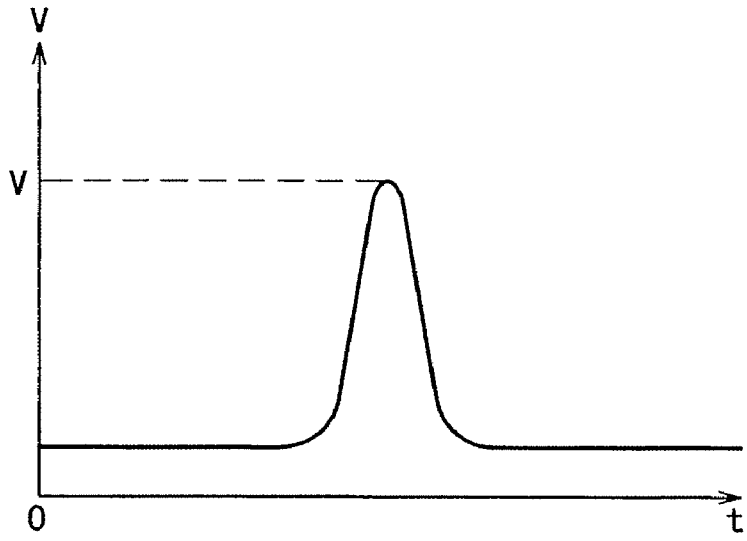
FIG. 8A is a graph of the optical power received by the light-receiving element when the ink droplet follows the trajectory T1.
Figure 8B:
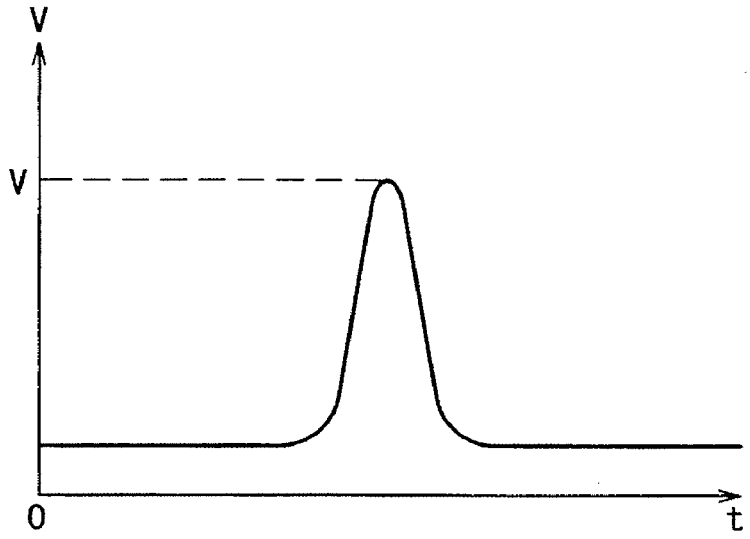
FIG. 8B is a graph of the optical power received by the light-receiving element when the ink droplet follows the trajectory T3.

FIG. 8A is a graph of the optical power received by the light-receiving element when the ink droplet 36 follows the trajectory T1, and FIG. 8B is a graph of the optical power received by the light-receiving element when the ink droplet 36 follows the trajectory T3.

As described above, because the ink droplet 36 passes the center of the beam 31, when the nozzle nx discharges the ink droplet 36 correctly, the light-receiving element 33 outputs the high voltage V as shown in FIG. 8A. For the same reason, when the trajectory bends in parallel with the nozzle array, the light-receiving element 33 outputs the same high voltage V as shown in FIG. 8B.

Figure 9:
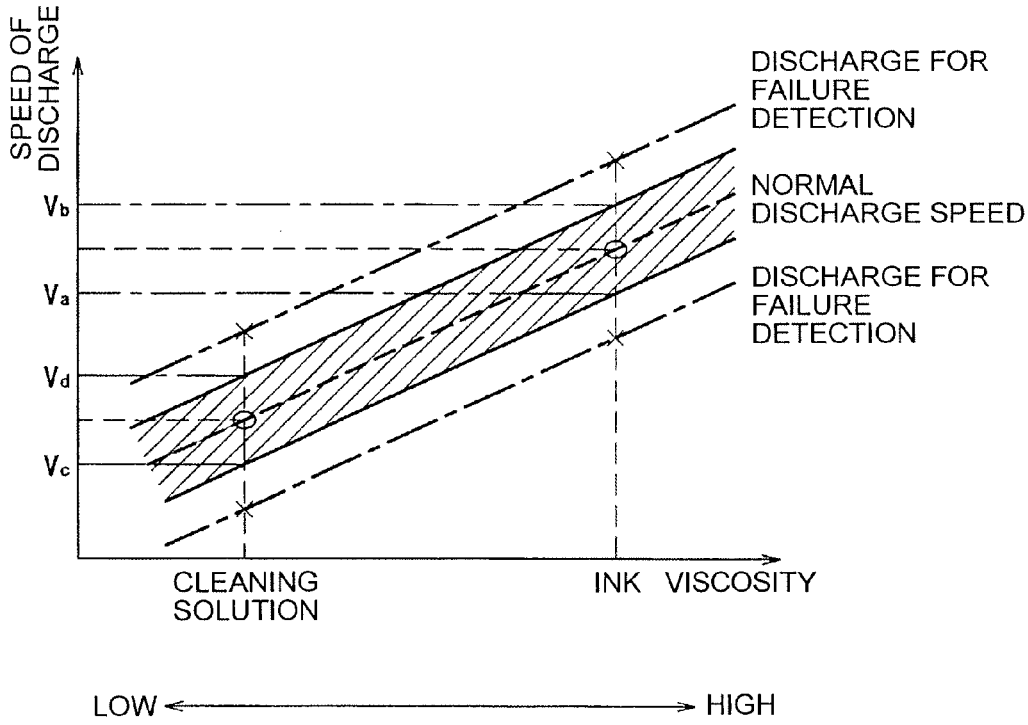
FIG. 9 is a graph of relation between viscosity and speed of the liquid discharged from the nozzle.

FIG. 9 is a graph of relation between viscosity and speed of a droplet discharged from the nozzle nx. A range of normal discharge speed is indicated by a shadowed area. When the viscosity of the droplet discharged from the nozzle nx is high, the normal discharge speed is high. For example, when ink is discharged, the normal discharge-speed range is between $V_a$ and $V_b$. However, when cleaning solution with lower viscosity than that of the ink is discharged, the normal discharge-speed range is between $V_c$ and $V_d$, which are lower than $V_a$ and $V_b$. In this manner, the normal discharge-speed range is determined based on the viscosity of the droplet to be discharged, and the speed of discharge is usually within the normal discharge-speed range.

When a normal nozzle discharges ink droplets based on a pulse waveform within the normal discharge-speed range, the droplets coalesce during the flight as described above, and the coalesced droplet falls on the sheet 23. When the speed of discharge increases outside the normal discharge-speed range, the only difference is that a point of coalescence is farther from the inkjet head surface 37, as long as the droplets are discharged correctly.

On the contrary, when there is a liquid discharge failure and the speed of discharge increases outside the normal discharge-speed range, the ink droplets do not coalesce. Instead, the ink droplets can remain split or change their directions. When one of the droplets discharged at a normal speed follows a bending trajectory and it coalesces with another ink droplet, the coalesced droplet is attracted to the bending trajectory resulting in deviation from a correct trajectory. Furthermore, when the speed of discharge is high, a preceding ink droplet has already passed the point of coalescence before a following droplet reaches the point of coalescence, resulting in a split droplet that can be easily detected.

Although a case of increasing the speed outside the normal discharge-speed range is explained above, in a case of decreasing the speed outside the normal discharge-speed range, due to weakness in ejecting the ink droplet, the ink gets stuck on the foreign object to cause non-discharge or the bending trajectory.

As described above, a liquid discharge failure is amplified when ink droplets are discharged at a speed deviated from the normal discharge-speed range. Taking advantage of this fact, the liquid-discharge-failure detecting apparatus 20 includes a discharge-speed controller (not shown) that controls the speed of discharge of the droplet from the nozzle nx to be set at a speed deviated from the normal discharge-speed range during the detecting process of a liquid discharge failure. To set the speed at a speed outside the normal discharge-speed range, the discharge-speed controller increases the drive voltage from $V_1$ to $V_2$ shown in FIG. 3A or decreases the drive voltage from $V_1$ to $V_3$ shown in FIG. 3B.

The speed of discharge can be also changed by changing a diameter of the nozzle and changing viscosity of the droplet. With the same drive waveform, the speed of discharge can be increased by employing a nozzle of a smaller diameter or employing a liquid having a lower viscosity.

Figure 10A:
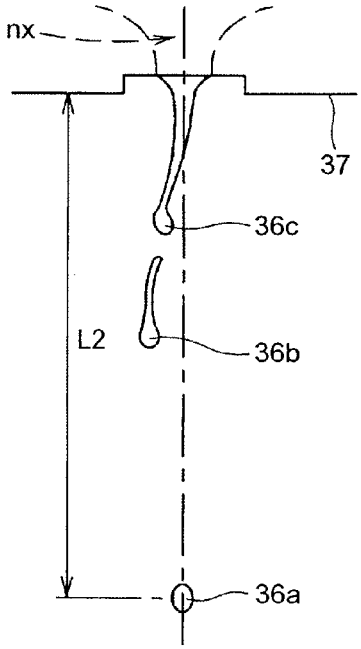
FIGS. 10A and 10B are schematic diagrams for explaining a mechanism of discharging the droplet when drive voltage increases.
Figure 10B:
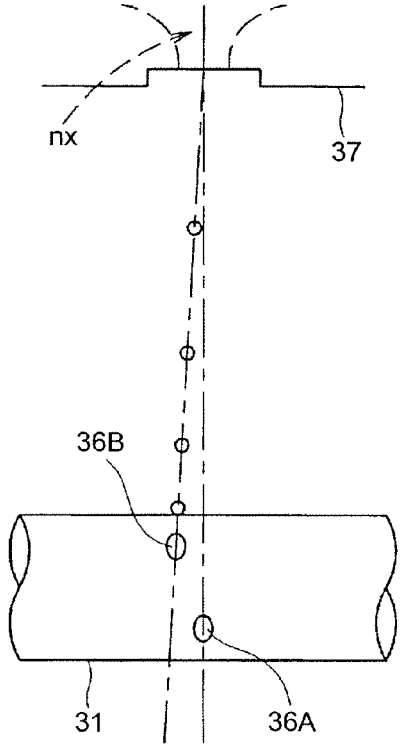

FIGS. 10A and 10B are schematic diagrams for explaining a mechanism of discharging the droplet when the drive voltage increases. Some of the ink droplets 36*a*, 36*b*, and 36*c* discharged continuously follow the bending trajectory. The distance between the ink droplet 36*a* and the inkjet head surface 37 is L2 in FIG. 10A longer than L1 shown in FIG. 7A because the ink droplet 36*a* is discharged more strongly with the increased drive voltage, i.e., because the speed of discharge of the droplet 36*a* is higher in FIG. 10A. For this reason, the ink droplets 36*a*, 36*b*, and 36*c* fly in the form of two ink droplets 36A and 36B as shown in FIG. 10B instead of coalescing into one droplet as shown in FIG. 7C.

Figure 11:
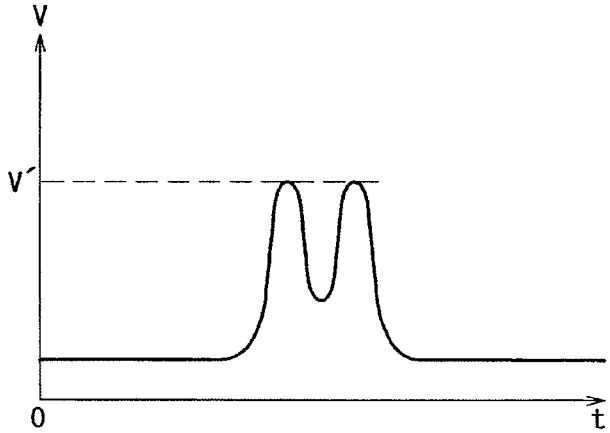
FIG. 11 is a graph of the optical power received by the light-receiving element in the case shown in FIGS. 10A and 10B.

FIG. 11 is a graph of the optical power received by the light-receiving element 33 when the two ink droplets 36A and 36B fly. The waveform has two peaks, and the peak voltage is V' lower than V because the ink droplets 36A and 36B is smaller than the normal ink droplet 36, thereby the liquid discharge failure is detected. In the case of the trajectory T2 shown in FIG. 4, the waveform has two peaks and the peak voltage is even lower than V' due to deviation from the center of the beam 31. The peak voltages are lower because each of the ink droplets is smaller generating scattered light with lower optical intensity.

The cause of the failure can be a foreign object near the nozzle, on an edge of the nozzle, or in the nozzle. When the drive voltage decreases, the ink gets stuck on the foreign object to cause a liquid discharge failure. As a result, the light-receiving element 33 does not output any voltage, which means there is a liquid discharge failure.

The rise time of the drive waveform and the amplitude of the waveform also affect discharge of ink droplets. Therefore, although not shown in the drawings, the liquid discharge failure can be amplified by changing the rise time of the drive waveform and/or amplitude of the waveform.

Figure 12:
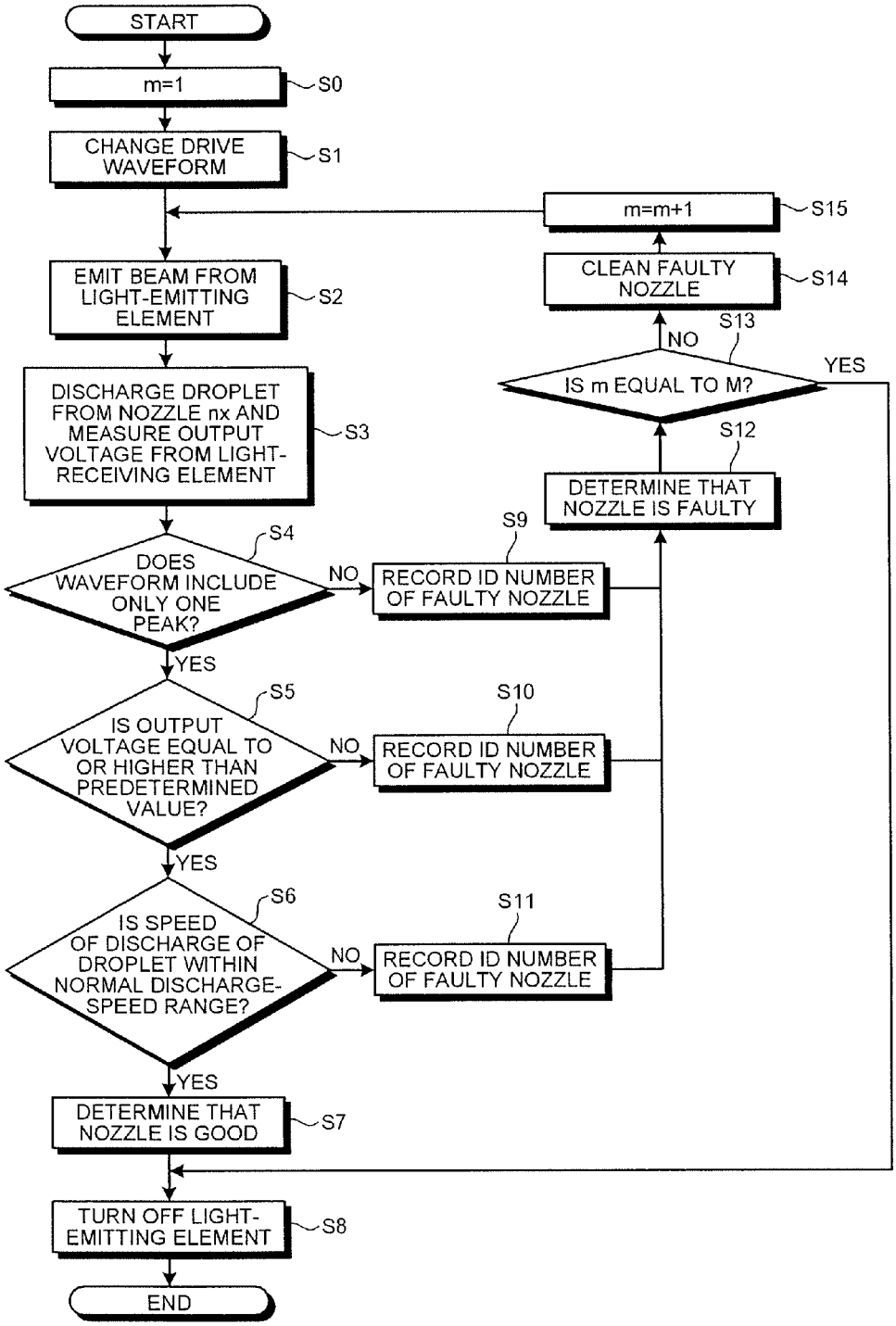
FIG. 12 is a flowchart of a detecting process for detecting a liquid discharge failure.

FIG. 12 is a flowchart of a detecting process for detecting a liquid discharge failure. A number indicative of the number of times that the detecting process is performed is set at m (Step S0). The drive waveform of the drive voltage is changed to one of the drive waveforms indicated by dotted curves shown in FIGS. 3A and 3B (Step S1). The light-emitting element 30 emits the beam 31 (Step S2). The nozzle nx discharges the ink droplet 36, and voltage output from the light-receiving element 33 indicative of the optical power of the forward-scattered light from the ink droplet 36 is measured (Step S3). Whether the waveform includes only one peak (Step S4), whether the output voltage is equal to or higher than a predetermined value (Step S5), and whether the speed of discharge of the droplet is within the normal discharge-speed range (Step S6) are determined. When all of these conditions are satisfied (YES at Steps S4, S5, and S6), it is determined that the nozzle nx is good (Step S7). The light-emitting element 30 is then turned off (Step S8), and the detecting process on the nozzle nx ends.

If the result of determination at any one of Steps S4, S5, and S6 is NO (NO at Steps S4, S5, or S6), an ID number of the nozzle nx is recorded as a faulty nozzle (Steps S9, S10, or S11), and it is determined that the nozzle nx is faulty (Step S12). Whether m is equal to M is then determined (Step S13). When m is less than M (NO at Step S13), the nozzle nx is cleaned using the stand-alone recovery unit 18 (Step S14), m increments by one (Step S15), and the process returns to Step S2. When m is equal to M (YES at Step S13), it is determined that the nozzle nx cannot be recovered, the light-emitting element 30 is turned off (Step S8), and the detecting process on the nozzle nx ends. The same procedure is then repeated for the other nozzles.

For example, when the waveform includes two peaks, the cause of the failure is considered to be a foreign object around the nozzle nx. The foreign object could be cleaned just by using a cleaning solution. In such a case, therefore, the nozzle is cleaned by using a suitable cleaning solution.

In the detecting process explained above, the drive waveform of the drive voltage is changed at Step S1. However, the detecting process can be performed with the normal waveform at first, and only when a slight difference is detected in the optical output or the speed of discharge, i.e., only when it is hard to determine whether the nozzle is faulty, the drive waveform can be changed on the nozzle in question to determine whether the nozzle is faulty.

Instead of the ink droplets, for example, cleaning solution can be used to perform the detecting process. When the cleaning solution is used, the liquid-discharge-failure detecting apparatus cleans the nozzles while performing the detecting process. In this manner, cleaning after the detecting process is not required, and thus time for the cleaning can be reduced.

According to an aspect of the present invention, because a liquid-discharge-failure detecting apparatus amplifies a liquid discharge failure, and performs a detecting process using a recording nozzle instead of using a detection nozzle, detection result is reliable, production cost is low, and the liquid discharge failure is detected without moving both a nozzle and an optical system.

Furthermore, by discharging cleaning solution, the liquid-discharge-failure detecting apparatus can perform two processes at the same time: cleaning on the nozzle and detecting a liquid discharge failure.

Moreover, when the liquid-discharge-failure detecting apparatus detects a liquid discharge failure, a stand-alone recovery unit recovers a faulty nozzle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-discharge-failure detecting apparatus that detects a liquid discharge failure of a nozzle being arranged on an inkjet head surface and discharging droplets of a liquid, the liquid-discharge-failure detecting apparatus comprising:

a discharge-speed controller that controls a speed of discharge of droplets discharged from the nozzle to be set, during a detecting process of the liquid discharge failure, at a speed deviated from a speed, which is usually used, of droplets discharged from the same nozzle;

a light-emitting element that emits a beam onto a droplet discharged from the nozzle;

a light-receiving element that receives a scattered light generated by scattering of the beam by the droplet; and a failure detecting unit that detects the liquid discharge failure from data of the scattered light received by the light-receiving element.

2. The liquid-discharge-failure detecting apparatus according to claim 1, wherein the discharge-speed controller adjusts a drive waveform of a drive voltage for discharge from the nozzle such that the speed of discharge of the droplet is controlled to be set at the speed deviated from the speed, which is usually used, during the detecting process of the liquid discharge failure.

3. The liquid-discharge-failure detecting apparatus according to claim 1, wherein the nozzle is configured to discharge an ink during the detecting process of the liquid discharge failure.

4. The liquid-discharge-failure detecting apparatus according to claim 1, wherein the nozzle is configured to discharge a cleaning solution during the detecting process of the liquid discharge failure.

5. An inkjet recording apparatus including a liquid-discharge-failure detecting apparatus that detects a liquid discharge failure of a nozzle being arranged on an inkjet head surface and discharging droplets of a liquid, the liquid-discharge-failure detecting apparatus comprising:

a discharge-speed controller that controls a speed of discharge of droplets discharged from the nozzle to be set, during a detecting process of the liquid discharge failure, at a speed deviated from a speed, which is usually used for recording, of droplets discharged from the same nozzle;

light-emitting element that emits a beam onto a droplet discharged from the nozzle;

a light-receiving element that receives a scattered light generated by scattering of the beam by the droplet; and a failure detecting unit that detects the liquid discharge failure from data of the scattered light received by the light-receiving element.

6. The inkjet recording apparatus according to claim 5, further comprising a stand-alone recovery unit that recovers a faulty nozzle.

7. A method of detecting liquid discharge failure of a nozzle being arranged on an inkjet head surface and discharging droplets of a liquid, the method comprising:

controlling a speed of discharge of droplets discharged from the nozzle to be set, during a detecting process of the liquid discharge failure, at a speed deviated from a speed, which is usually used, of droplets discharged from the same nozzle; and emitting a beam onto a droplet discharged from the nozzle with a light-emitting element and receiving a scattered light generated by scattering of the beam by the droplet with a light-receiving element; and detecting the liquid discharge failure from data of the scattered light received by the light-receiving element.

* * * * *